US005544765A

United States Patent [19]

Farbman

[11] Patent Number: 5,544,765

[45] Date of Patent: Aug. 13, 1996

[54] COLLAPSIBLE GARMENT SUPPORT RACK

[76] Inventor: Edwin L. Farbman, 3020 Valencia Ter., Charlotte, N.C. 28211

[21] Appl. No.: 173,417

[22] Filed: Dec. 23, 1993

[51] Int. Cl.[6] ..... A47F 7/00

[52] U.S. Cl. ..... 211/189

[58] Field of Search ..... 211/189, 191, 211/105.1, 123; 410/143, 145, 144, 149

[56] References Cited

U.S. PATENT DOCUMENTS

| | | | |
|---|---|---|---|
| 2,468,101 | 4/1949 | Nampa | 410/150 |
| 2,546,929 | 3/1951 | Nampa | 410/147 |
| 3,506,136 | 4/1970 | Burda et al. | 211/189 |
| 4,753,355 | 6/1988 | Hall et al. | 211/105.1 |
| 4,772,165 | 9/1988 | Bartkus | 410/150 X |
| 5,314,276 | 5/1994 | Barone | 410/149 X |

*Primary Examiner*—Alvin C. Chin-Shue
*Assistant Examiner*—Sarah L. Purol
*Attorney, Agent, or Firm*—Shefte, Pinckney & Sawyer

[57] ABSTRACT

A collapsible garment support rack for transportation of manufactured garments disposed on conventional hangers includes a plurality of vertically oriented support members and a plurality of horizontally oriented garment support members arranged to form a collapsible skeletal frame for occupation of the interior of a conventional box. A garment clamping arrangement is also provided to releasably retain garment hangers suspended therefrom.

27 Claims, 10 Drawing Sheets

COLLAPSIBLE GARMENT SUPPORT RACK

BACKGROUND OF THE INVENTION

The present invention relates to support racks for clothing, and, more particularly, to a collapsible garment support rack for transportation of a plurality of garments disposed on hooked garment hangers in a cargo container.

When clothing, such as shirts, jackets, coats, trousers or the like are manufactured, typically fabric is shipped to a factory, the garments are sewn, or otherwise assembled, and then transported to distributors on hangers for distribution to retail stores. Currently, finished garments are typically shipped in conventional semi trailers or, for off-shore manufacturing, in cargo containers which are typically rectangular box-like containers configured for shipment in ships and adaptable for disposition on rail cars or on flat-bed trailers to form a cargo trailer similar to semi trailers. In any event, the conventional method for stowing and positioning the garments within the cargo container is to suspend a plurality of ropes from the trailer ceiling to extend, typically, to the floor of the trailer. A series of knots is formed in each rope and garments disposed on conventional hooked garment hangers are suspended from the knots in groups. This method keeps the clothing off of the floor of the container yet offers little else in the way of garment protection. Garments are clustered around the knots in bunches, and often some garments will fall to the floor of the cargo container, resulting in wrinkles, soiling or damage to the garment. Therefore, upon arrival, the garments must typically be cleaned and pressed before they will be accepted and sold in commerce. This cleaning and pressing adds significantly and unnecessarily to the cost of garment manufacture.

Typically, the cargo container will be returned to the factory with a load of raw materials for a return trip to the garment manufacturer, and the ropes can interfere with such return shipments, even with the ropes pushed aside or tied to a support within the trailer.

Therefore, it is desirable to ship the garments on a support rack in a condition which would not require cleaning and pressing on arrival, wherein the rack can be easily disassembled once garments are removed from the cargo container for return shipment of the disassembled rack to the manufacturer in the cargo container, sharing the space with the aforesaid raw materials.

SUMMARY OF THE INVENTION

It is accordingly an object to the present invention to provide a garment support system which addresses the above-described concerns.

More specifically, it is an object of the present invention to provide a collapsible garment support rack for transportation of a plurality of garments disposed on hooked garment hangers in a cargo container of a general type having a covered cargo support surface. The cover is generally box-like and includes a plurality of generally planar vertically oriented, opposing side wall members, generally vertically oriented end wall members, and a generally planar ceiling member disposed on the wall members, defining an interior for cargo stowage.

According to a first preferred embodiment of the present invention, the collapsible garment rack includes an assembly for forming a garment supporting frame structure configured for occupation of the interior of the cargo container. Preferably the frame forming assembly includes a skeletal frame structure substantially conforming in dimension with the interior of the cargo container and including a plurality of generally vertically oriented support members for disposition in a spaced relationship adjacent the side wall members providing a plurality of adjacent and opposing support members. The frame structure further includes a garment support assembly extending between opposing support members for supporting garments for transportation thereof and a spacer arrangement extending between the adjacent support members for maintaining a predetermined spacing therebetween. The present invention also includes an assembly for facilitating movement of the frame forming assembly between a garment support condition wherein the frame forming assembly is configured in an assembled disposition for occupation of the interior of the cargo container for transportation of garments and a stowage condition wherein the frame forming assembly is configured in a disassembled disposition for transportation of the frame forming assembly.

It is preferred that the central support members and the opposing vertical support members are joined by at least one horizontally disposed cross member to form a primary frame structure, the primary frame structures being stackable when the garment rack is in its stowed condition. A plurality of pins preferably projects outwardly from one surface of the vertical support members and a plurality of corresponding openings is formed in an opposite surface thereof for mating of adjacent stacked primary frame structures when the garment rack is in its stowed condition.

Preferably, the frame forming assembly includes a starter frame member including two vertical support members a plurality of cross-brace members extending therebetween and an arrangement for removably mounting the spacer arrangement thereon to join the starter frame member with the vertical support members. The starter frame member is for erection adjacent the end wall of the cargo box when the frame forming assembly is in a garment support condition and for disposition on the stacked remainder of the frame forming assembly when the frame forming assembly is in a stowed condition for supporting cargo thereon.

Preferably, the garment support assembly includes a plurality of elongate rods configured to extend between opposing vertical support members and a clamping arrangement attached to the rod for releasably retaining garments being transported thereon. It is preferred that the hanger clamping arrangement include an elongate bar resiliently biased into a spaced relationship with the rod for insertion of hanger hook portions therebetween. The bar is movable between an opened condition for insertion and removal of hangers wherein the bar is biased away from the rod and a clamped condition for retention of hangers wherein the bar is biased toward the rod and into contact with the hangers.

It is preferred that the spacer assembly include a plurality of elongate horizontally oriented support members configured to extend between adjacent vertical support members. The spacer members may include an arrangement for varying the length thereof thereby allowing the adjacent vertical support members to be disposed at predetermined spacings along the cargo container side walls dependent on garment width. Further, it is preferred that the frame forming assembly include a plurality of upstanding central support members disposed intermediate the opposing vertical support members with the garment support assembly extending between the vertical support members and the central support members. It is further preferred that the arrangement for facilitating rack movement include a plurality of bracket members mounted to the vertical support members and configured for removably retaining the spacer arrangement and the garment support assembly. Both the spacer members and the garment supports members are movable between the bracket members. The garment support members are mountable to the bracket members at predetermined vertical spacings thereby allowing the garment support rack of the present invention to accommodate garments of various different lengths.

The frame forming assembly preferably includes a starter frame member including at least two vertical support members, a plurality of cross brace members extending therebetween and an arrangement for removably mounting the spacer members thereon to join the starter frame with the vertical support members. The starter frame is for erection adjacent the end wall of the cargo container when the frame forming assembly is in a garment support condition and for disposition on the stacked remainder of the frame forming assembly when the frame forming assembly is in a stowed condition for supporting cargo thereon. The starter frame member provides a foundation for beginning assembly of the garment supporting frame structure.

According to a second preferred embodiment of the present invention, the frame forming assembly includes a plurality of subframe members pivotably mounted to the cargo floor adjacent and along each opposing side wall member providing a plurality of adjacent subframe members and a plurality of opposing subframe members, each subframe member including an assembly for supporting garments thereon and being pivotable between a garment support condition wherein the subframe members are oriented in a generally perpendicular relation with the side wall members and a stowed condition wherein the subframe members are oriented in a generally parallel relation with the side wall members. Preferably, each subframe includes two vertically oriented support members in a spaced generally parallel relation with at least one garment support member extending therebetween. The garment support members are configured like the garment support members of the first preferred embodiment of the present invention. The subframes include bracket members positioned along the vertical support members thereof for removably retaining the garment support members therein. Preferably, the garment support members are movable between the bracket members for removably mounting the garment support members at predetermined vertical spacings thereby allowing the garment support rack of the present invention to accommodate garments of various different lengths.

It is further preferred that the subframes are in a generally aligned, opposed configuration when positioned in the garment support condition and each vertical support member includes a plurality of bracket members mounted thereon in a spaced vertical relation. Garment support members are selectively and removably mountable in the bracket members to extend between opposed subframe members to retain the subframes in the garment supporting condition. The garment support members are movable between the bracket members, thereby allowing the garment support members to be mounted at predetermined vertical spacings dependent on garment height.

It is further preferred that the garment support rack further include an arrangement for selectively and removably mounting the adjacent subframe members at predetermined spacings for accommodation of garments of various widths. This subframe mounting arrangement preferably includes a plurality of openings formed in both the cargo floor and the ceiling member along and adjacent the side walls and a plurality of mounting members projecting from each subframe and configured for mating with the openings.

By the above, the present invention provides a collapsible garment support rack in two preferred embodiments, each providing a garment support rack movable between a garment supporting condition for transporting garments in a cargo container and a stowed condition for transporting the garment support rack. The garment support members of each embodiment are selectively positionable at predetermined vertical spacings so that the garment support rack of the present invention can be configured for transporting garments of various lengths, even within the same shipment.

DESCRIPTION OF THE PREFERRED EMBODIMENT

Figure 1:
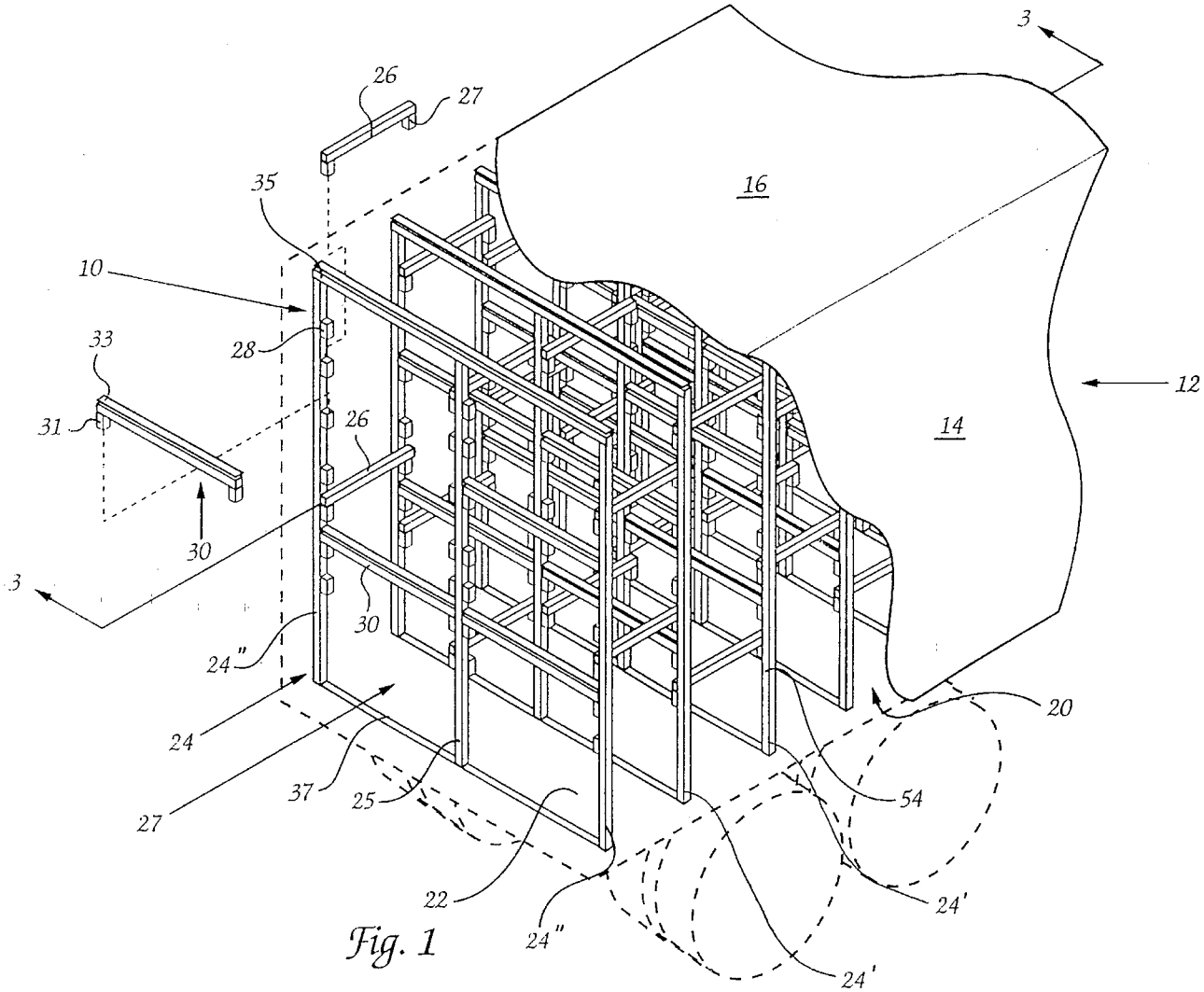
FIG. 1 is a perspective view of the rear portion of a collapsible garment rack according to a first preferred embodiment of the present invention and illustrating the placement of the garment support member and the spacer members.

Referring now to the accompanying drawings and, more particularly, to FIG. 1, a collapsible garment rack for transportation of garments on hangers according to a first preferred embodiment thereof is illustrated generally at 10 and shown disposed in the interior of a conventional cargo container 12 which is shown partially broken away for illustrative purposes. The cargo container 12 includes a plurality of upstanding wall members disposed on a generally planar floor 22, arranged in a rectangular configuration and including two opposing side wall members 14, an end wall member 15 (see FIG. 2) and two doors (not shown) disposed at the opposite end providing access to the cargo container 12. The side wall members 14, end wall member 15, and doors have a generally planar ceiling 16 disposed thereon and, with the cargo floor 22, define an interior compartment 20.

With continued reference to FIG. 1, the garment rack 10 is configured to conform generally to the dimensions of the interior compartment 20 of the cargo container 12 when assembled. The garment rack 10, when assembled, has a generally skeletal frame construction and includes a plurality of vertically oriented support members 24 which may be formed of steel channel members or the like. While it is preferred that the garment support rack of the present invention be constructed of steel channel members, it is contemplated that other materials, such as aluminum, could be utilized. The vertical support members 24 are disposed adjacent the wall members 14 in a spaced, generally parallel relation. This arrangement provides a row of vertical support members 24 along each wall member 14 of the cargo container 12, providing both adjacent and opposing vertical support members 24',24", respectively. A plurality of vertically oriented central support members 25 are disposed intermediate opposing vertical support members 24" and are arranged in a row from a disposition adjacent the end wall 15 to a disposition adjacent the doors (not shown). Each two opposing vertical support members 24" and the central support member 25 disposed therebetween are joined at the uppermost extent thereof by an upper cross member 35 and at the lowermost extent thereof by a lower cross member 37 to form a primary frame structure 27. Each primary frame structure 27 is provided with a plurality of alignment pins 52 projecting outwardly from one side of each vertical support member 24" and the central support member 25. Corresponding openings 54 are formed in the other side of each vertical support member 24" and the central support member 25, and are best seen in FIG. 1. The function of the alignment pins 52 and corresponding openings 54 will be explained in greater detail presently.

Figure 3:
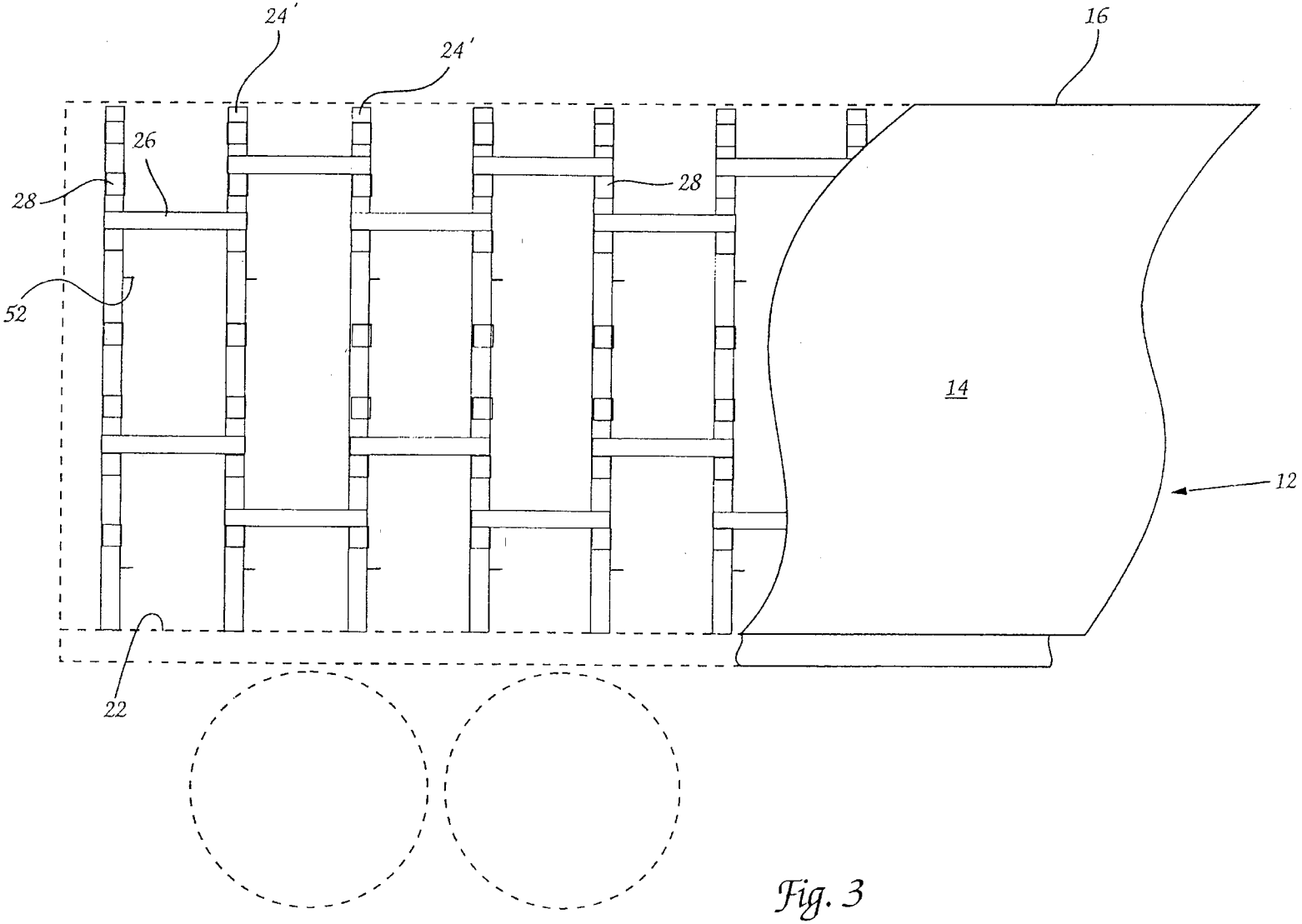
FIG. 3 is a side sectional view of an illustrative portion of the garment support rack shown in FIG. 1 taken along line 3—3 thereof.

As best seen in FIG. 3, a plurality of spacer members 26 extend in a vertically spaced, generally parallel relationship between any two adjacent vertical support members 24'. All vertical support members 24 have a plurality of hollow bracket members 28 mounted thereon at vertically spaced positions. The bracket members 28 are formed of steel channels or the like. Their function will be explained in greater detail hereinafter.

For garment support, a plurality of garment support members 30 are provided which extend between the vertical support members 24 and the central support members 25. The garment support members 30 are removably mountable in the bracket members 28 and will be explained in greater detail hereinafter.

Figure 2:
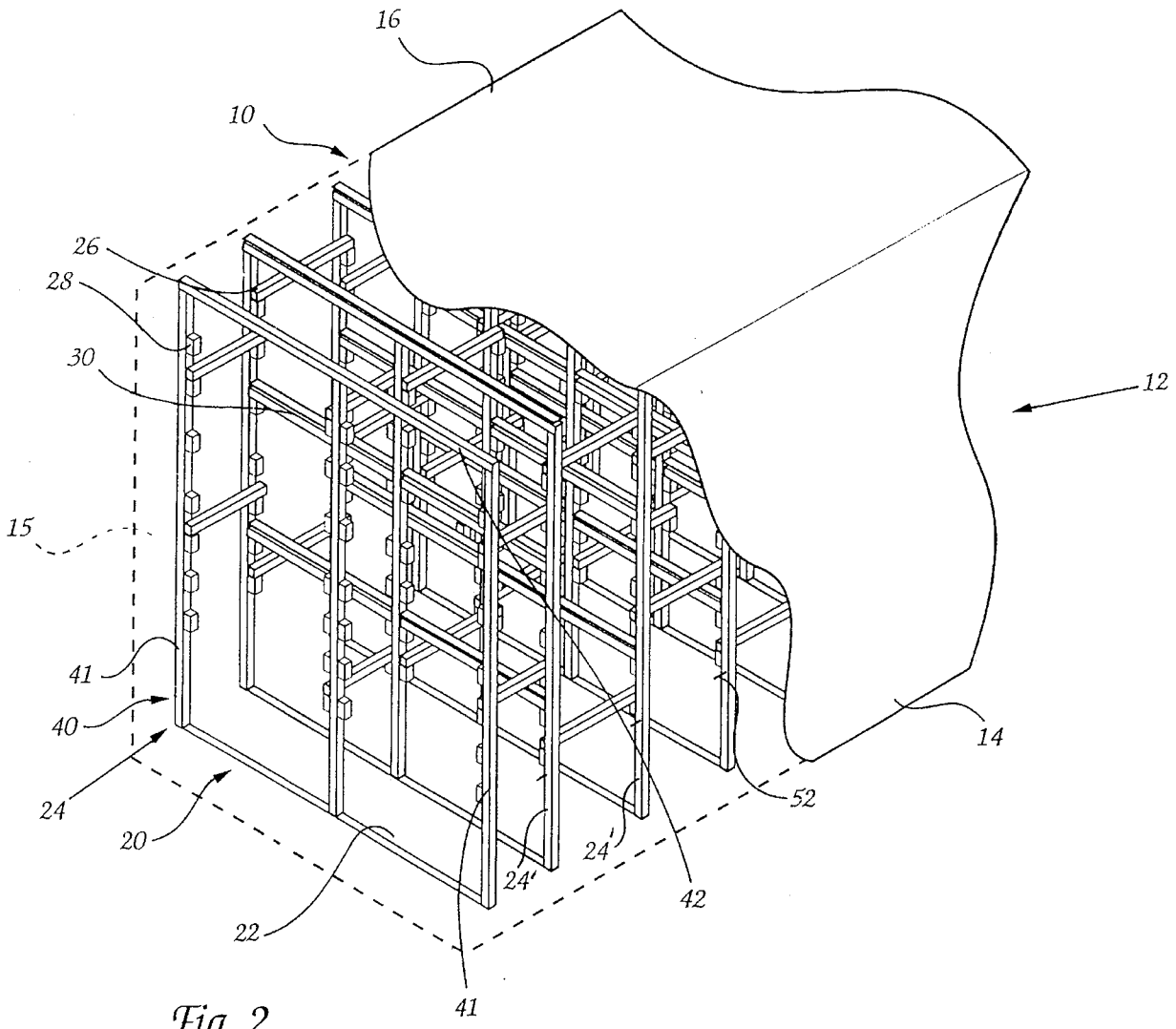
FIG. 2 is a perspective view of the front portion of the garment support rack shown in FIG. 1, illustrating the starter frame.
Figure 7:
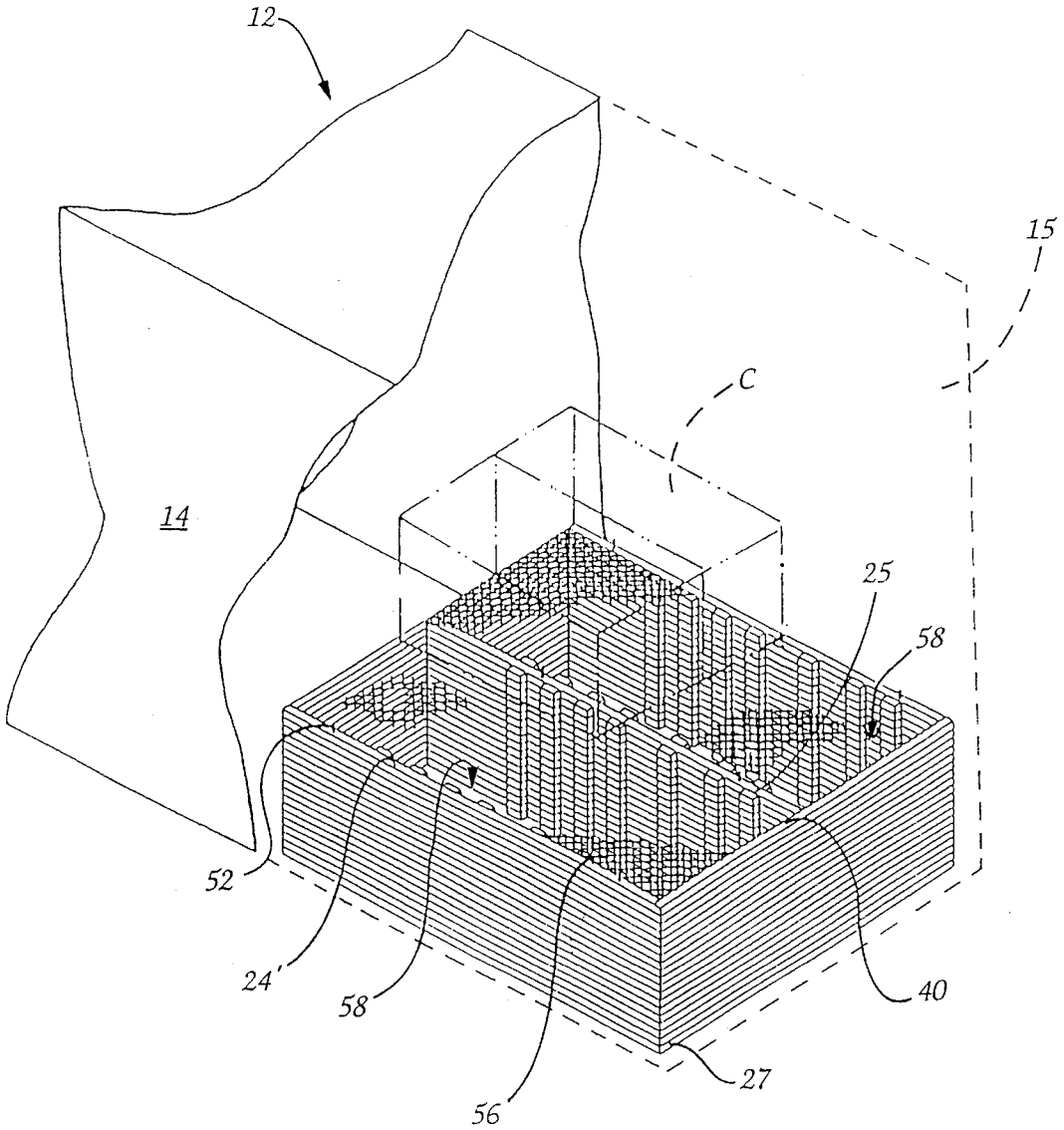
FIG. 7 is a perspective view of the garment support rack illustrated in FIG. 1 in its stowed condition.

Referring now to FIG. 2, a starter frame member 40 is disposed adjacent with the end wall member 15 and consists of three vertically oriented support members 41 and a plurality of horizontally extending cross brace members 42, and a generally planar screen 56. The screen 56 is not illustrated in FIG. 2 for clarity but may be seen in FIG. 7. The starter frame 40 may be easily erected adjacent the end wall 15 to commence assembly of the garment rack 10 and, as will be explained in greater detail hereinafter, with the garment rack 10 in a disassembled condition, the starter frame 40 rests on the stacked remainder of the garment rack to act as a cargo floor 22, as best seen in FIG. 7 and as will be explained in greater detail hereinafter.

Figure 5:
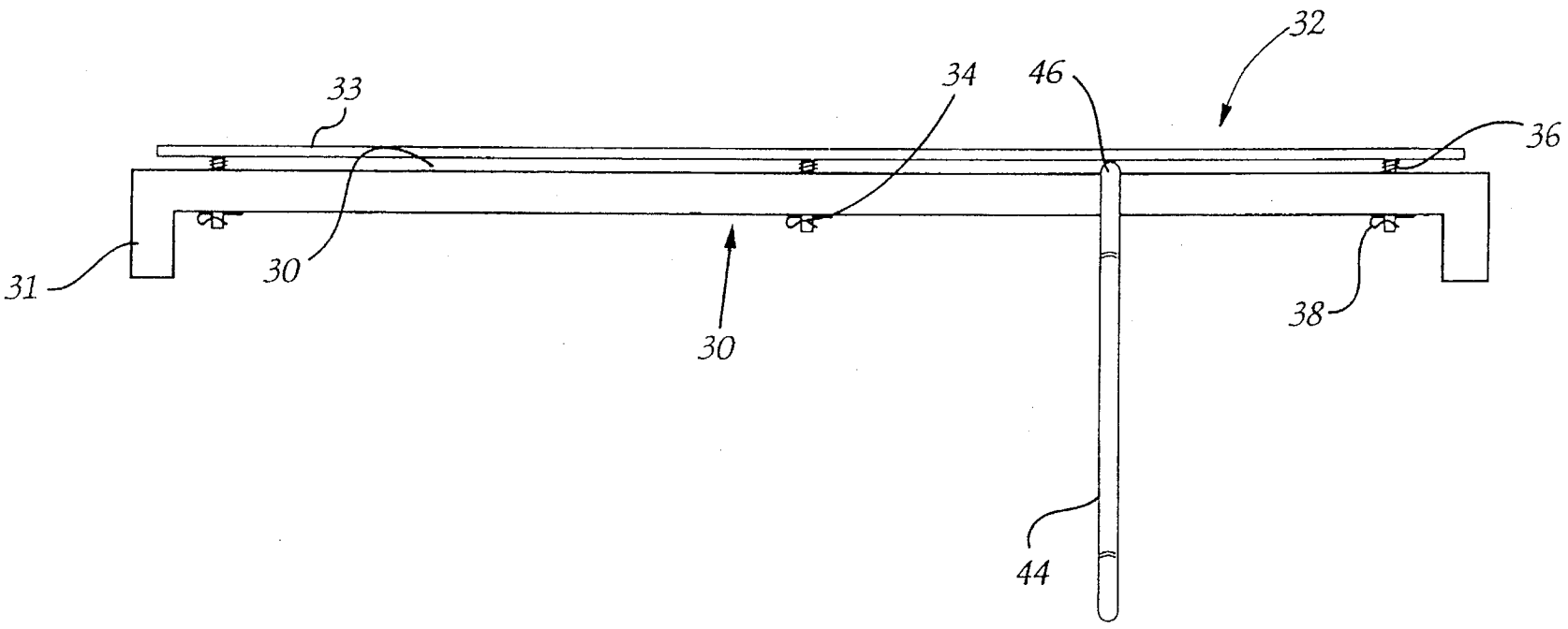
FIG. 5 is a front view of a garment support member illustrating the clamping assembly.

With reference to FIG. 5, a garment support member 30 and its associated clamping assembly 32 is illustrated. The garment support member 30 is a generally elongate bar having two downturned end portions 31 configured for insertion into, and removal from, the bracket members 28. The clamping assembly 32 includes a generally flat, elongate clamp bar 33 disposed in a generally spaced parallel relationship with the garment support member 30. A plurality of support posts 34 are mounted to the clamp bar 33 and extend downwardly through openings (not shown) formed in the garment support member 30 at spaced intervals and project outwardly therefrom. The clamp bar 33 is biased into a spaced relationship with the garment support member 30 using a plurality of springs 36 which surround the support posts 34 and abut both the clamp bar 33 and the upper surface 30' of the garment support member 30. The clamp bar 33 is movably disposed on the support posts 34 for translational movement toward and away from the garment support member 30.

When the clamp bar 33 is disposed away from the top surface 30' of the garment support member 30, a conventional hooked hanger 44 may be disposed in a hanging manner from the garment support member 30. The hook 46 of the conventional hanger fits in the spacing intermediate the clamp bar 33 and the garment support member 30. With a hanger 44, or a plurality of hangers, in place, the clamp bar 33 may be pressed downwardly into engagement with the hook 46 of the hanger 44. To retain the clamping assembly 32 in a clamped condition, the movable support posts 34 are configured to project beyond the garment support member 30 and conventional pins 38 are passed through openings (not shown) in the support posts 34 for retention of the support posts 34, and thereby the clamping bar 33, in a downward, clamped position.

Figure 6:
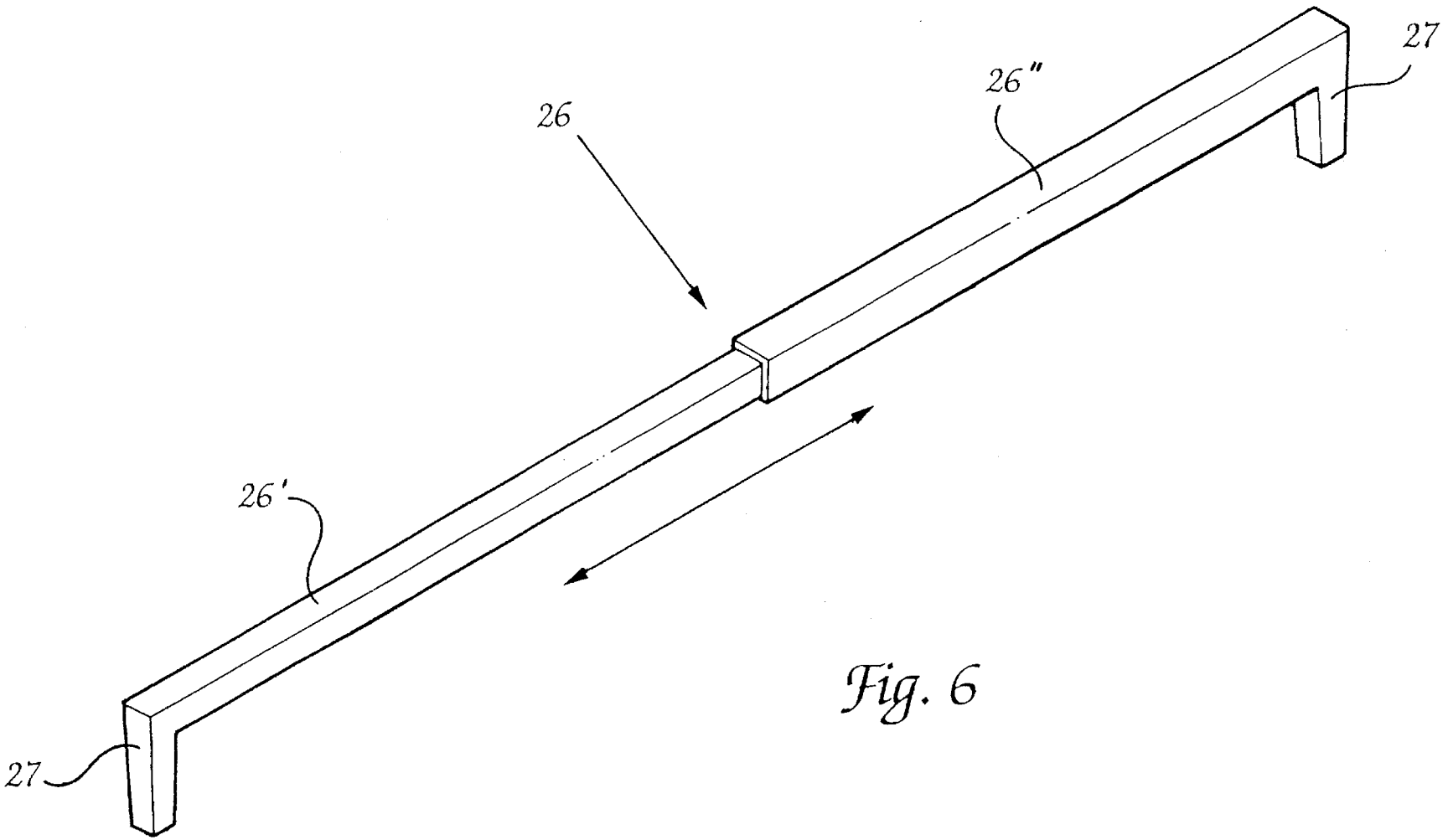
FIG. 6 is a perspective view of a spacer member illustrating the manner in which its length may be varied.

Turning now to FIG. 6, a spacer member 26 is illustrated and includes a generally elongate bar having two downturned end portions 27 configured for insertion into, and removal from, the bracket members 28. The end portions 27 may be tapered slightly for ease of insertion into the bracket members 28. Likewise, and although not illustrated, the garment support member end portions may also be tapered. Optionally, the spacer members 26 may be variable in length to accommodate various clothing widths. However, the spacer members 26 may be non-adjustable and formed with a predetermined length. A preferred method of varying the length of the spacer members 26 includes providing a telescoping spacer member 26 having two distinct portions 26',26" which may move relative to one another as indicated by an arrow in FIG. 6, to vary the length of the spacer members.

Returning now to FIG. 1, the aforesaid bracket members 28 are provided for facilitating movement of the garment support rack 10 from an assembled condition for garment support to a collapsed condition for stowage and transportation of the rack 10. The garment support members 30 and the spacer members 26 may be easily mounted to the brackets 28 or dismounted therefrom by inserting their respective downturned end portions 31,27 into the brackets 28.

In operation, and in preparation for the shipment of a plurality of garments disposed on conventional hangers, the garment rack of the present invention may be assembled in a cargo container. Initially, and with reference to FIG. 2, the starter frame 40 is positioned in the forward portion of the cargo container 12 with the screen 56 (not shown in FIG. 2) adjacent the end wall 15. A first primary frame 27 is then disposed a predetermined distance rearwardly, with respect to the cargo container 12, from the starter frame member 40 and a plurality of spacer members 26 are mounted in selected brackets 28 to extend from the starter frame member 40 to the vertical support members 24 and the central support member 25 of the primary frame 27. Optionally, the length of the spacer members 26 may be adjusted according to the width of the garments to be supported by the rack. Accordingly, with wide garments, the adjacent vertical support members 24' will be spaced farther apart than would be the case with narrower garments.

Figure 4:
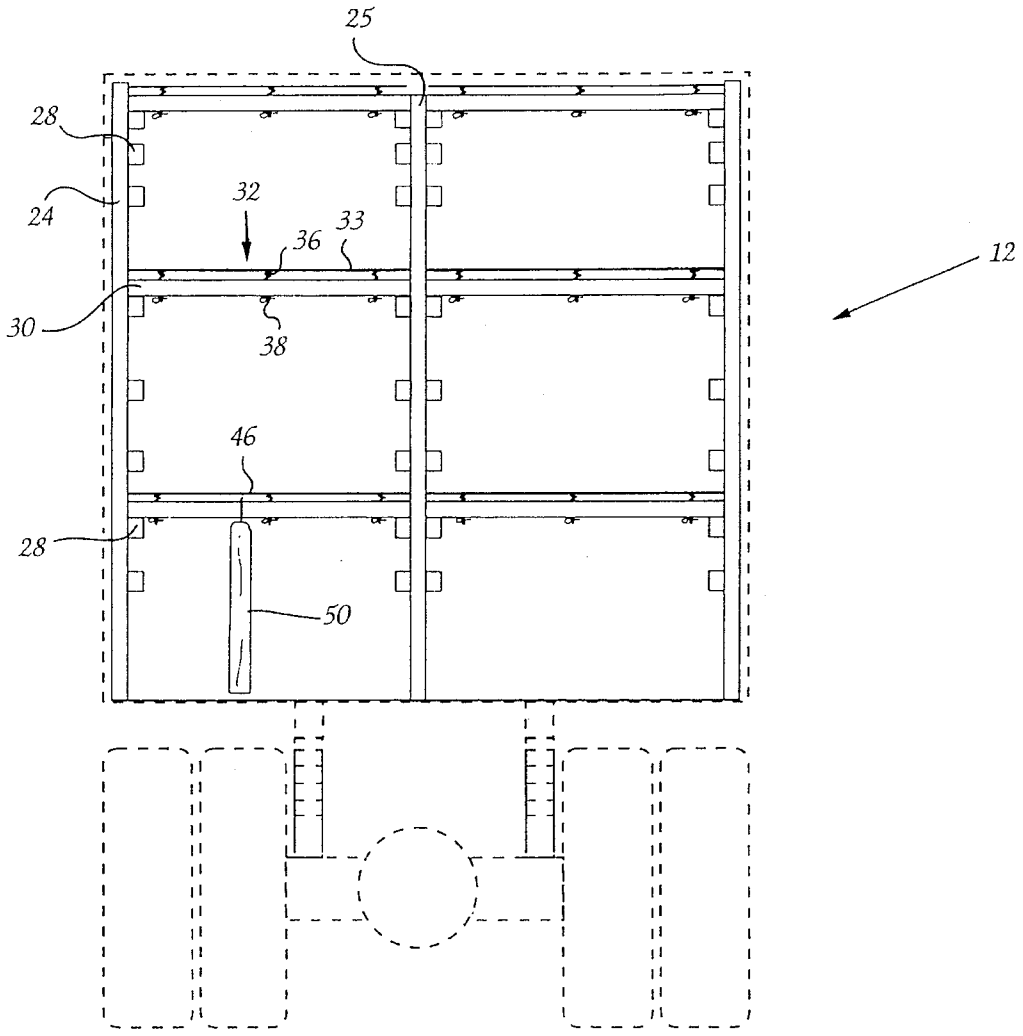
FIG. 4 is a rear view of the garment support rack illustrated in FIG. 1.

A plurality of garment support members 30 are then positioned with their end portions 31 extending into the bracket members 28, as seen in FIG. 1. Returning to FIG. 2, the garment support members 30 will then extend between the vertical support members 24 and the central support members 25. The bracket members 28 are disposed along the vertical support members 24 at various vertical spacings which provide the ability to arrange vertically spaced garment support members 30 according to garment height. Therefore, for short garments, additional support members 30 may be disposed intermediate the vertical support members 24 and the central support members 25 providing additional room. However, for longer garments, such as dresses, the garment support members 30 may be positioned at a greater vertical spacing. The arrangement of the starter frame member 40, the spacer members 26, the primary frame 27, and the garment support members 30 define a first frame row for garment support. Clothing is then suspended from each garment support member 30 and each clamping assembly 32 is closed over the hangers 44 in a manner previously described. This is best seen in FIG. 4. While FIG. 4 shows only one garment 50, it is to be understood that as each row is assembled, the garment support members 30 will be filled with hanging garments.

Moving rearwardly in the trailer, a second primary frame 27 and associated garment support members 30 are arranged and assembled a predetermined distance rearwardly within the cargo container from the first row, forming a second row for garment support. A plurality of spacer members 26 are then disposed with their end portions 27 in the bracket members 28 of adjacent vertical support members 24' and garment support members 30 are then fitted into additional bracket members 28 at predetermined locations. Garments 50 are then suspended from the garment support members 30. This process is then repeated. Clothing disposed on hangers is disposed on the garment support members 30 as the rows are erected so that as assembly of the garment rack 10 progresses from the forward portion of the cargo container 12 toward the rearward portion thereof, the garment support members 30 may be filled with garments 42, and once the garment rack 10 is assembled, it is also loaded. Once the garments 50 disposed on hangers 44 are suspended from the garment support members 30, the clamping bar 33 is biased into a clamping relation with the hanger hooks 46 and pins 38 installed to maintain the clamping assembly 32 in a closed condition as previously described.

Figure 8:
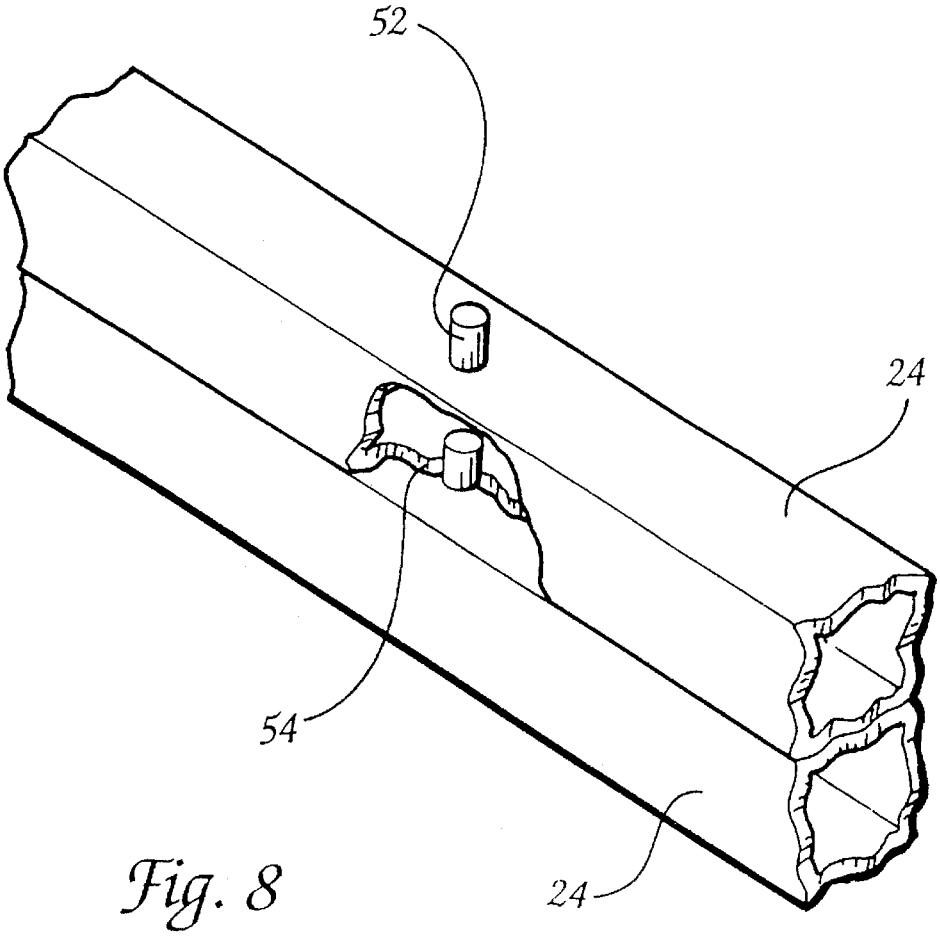
FIG. 8 is a perspective view of a portion of two vertical support members broken away to illustrate interlocking of frame members when in the stowed condition as illustrated in FIG. 7.

Once the garments have been transported to their destination, the garment support rack 10 may be disassembled in a manner oppositely from that in which it was assembled. The support members may then be stored in a stacked condition on the floor 22 of the cargo container 12 as illustrated in FIG. 7. With continued reference to FIG. 7, to stow the garment rack for transportation, the primary frames 27 are laid in a stack adjacent the end wall member 15. The alignment pins 52 of lower primary frames 27 are disposed in the corresponding openings 54 of adjacent, upper primary frames 27, as best seen in FIG. 8. This relationship prevents the stack of primary frames 27 from shifting during transit. Although not illustrated in FIG. 7, the garment support members 30 and the spacer members 26 may be disposed within the twin wells 58 created by the spacing intermediate the vertical support members 24 and the central support members 25 of the stacked primary frames 27. The starter frame member 40 is then positioned on the stacked primary frames 27, with the screen 56 providing a floor for stacking cargo C thereon, thereby allowing the cargo container 12 or semi trailer to be used for transporting other cargo as well as the disassembled garment rack 10. Optionally, wood panels (not shown) or other suitable planar members may be disposed on the starter frame member 40 for additional cargo support, With reference to FIG. 9, a second preferred embodiment of the present invention is illustrated and shown generally at 60. As with the first embodiment, the second embodiment provides a garment rack 60 which is movable between a garment support condition and a stowed condition. According to this embodiment, channels 68 are formed in the floor 22 of the cargo container 12 adjacent the side walls 14 thereof. A plurality of openings 70 is formed in linear alignment in the upper surfaces of each channel 68. A similar channel 72 is disposed in the ceiling 16 of the cargo container 12 with similar openings (not shown) formed therein. A subframe 62 is pivotably mounted intermediate the upper and lower channels 68,72. As will be apparent, adjacent subframes 62 may be selectively positioned along each side wall 14 using the openings 70 to accommodate garments of variable width.

The subframe 62 consists of two vertically oriented support members 64 maintained in a spaced relation by a lower horizontal support member 65 extending therebetween and a plurality of garment support members 30, as previously described, also extending therebetween. As exists in the first preferred embodiment, a plurality of brackets 28 are mounted to the vertical support members 64 at selected vertical spacings for removably retaining the garment support members 30 therein. With combined reference to FIG. 9 and FIG. 10, pivot pins 75 extend outwardly from one of the subframe vertical support members 64 for engagement with the openings 70 in the channels 68,72. Therefore, the subframe 62 may pivot in the manner of a door between a position wherein the subframe 62 is generally parallel with the side walls 14 of the cargo container 12 and a position wherein the subframe 62 is generally perpendicular with the side walls 14 of the cargo container 12. Further, since the pivot pins 75 are removably disposed within the openings 70, the subframes 62 may be selectively positioned in substantially any of the openings 70, providing a selective spacing between adjacent subframes 62 based on garment width. Similar subframes 62 are mounted adjacent each side wall 14 in opposition to one another.

A plurality of bracket members 28 are disposed on the outer surface of the vertical support members 64 so that when the subframes 62 are perpendicular with the side walls of the container 14 a garment support member 30 may be fitted within the brackets and extend between opposing subframes 62, as seen in FIG. 8.

Figure 9:
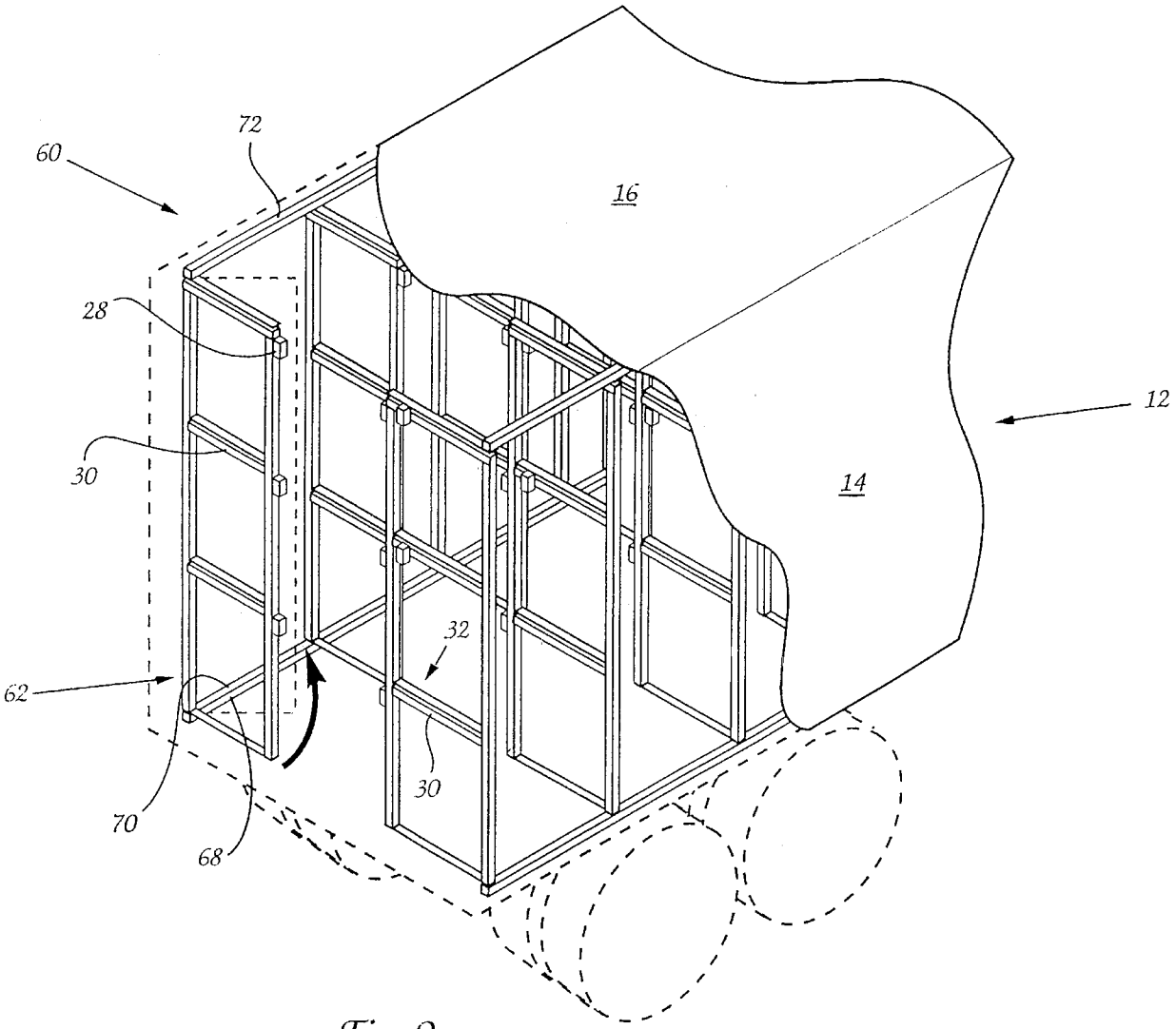
FIG. 9 is a perspective view of a collapsible garment track according to a second preferred embodiment of the present invention.
Figure 10:
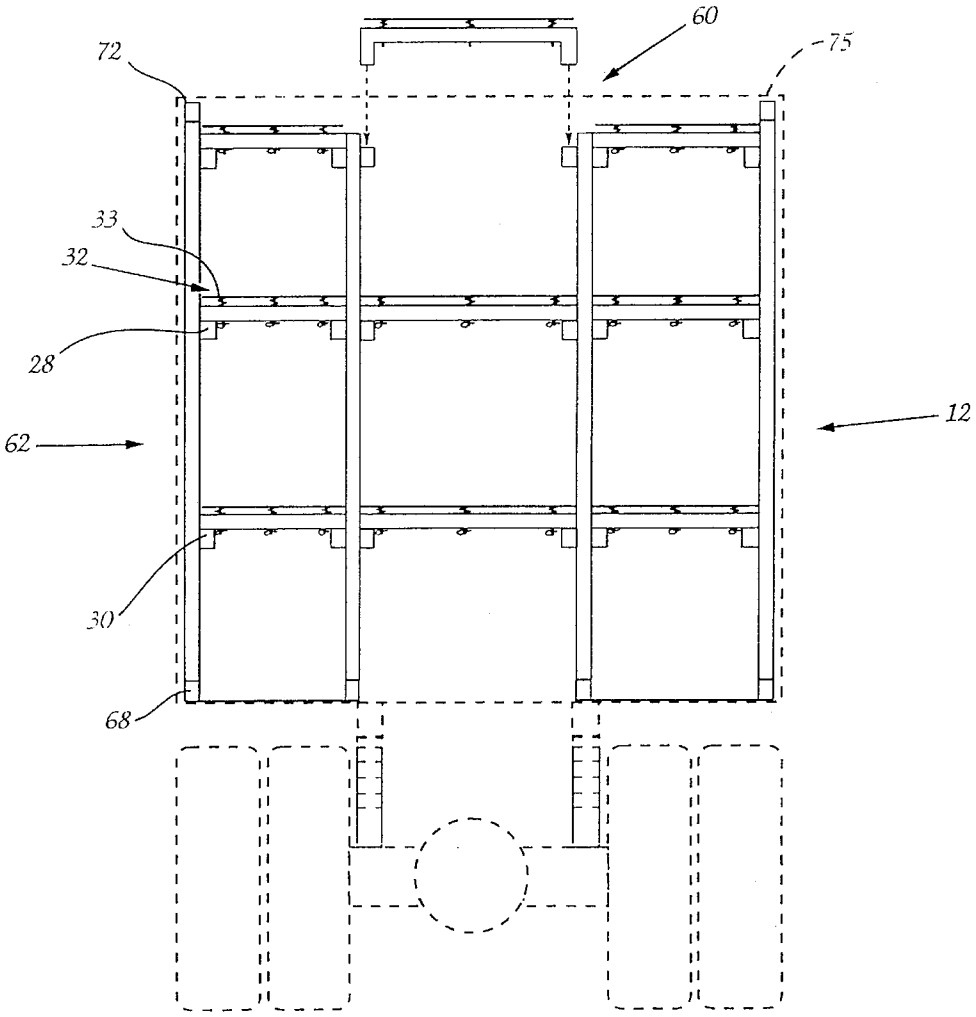
FIG. 10 is a rear end view of the garment track shown in FIG. 9, illustrating the installation of the garment support members.

With continued reference to FIGS. 9 and 10, the garment support rack 60 is movable between a stowed condition and a garment support condition as follows. Adjacent the end wall 15 of the cargo container 12 two opposing subframes 62 are pivoted into an opposing relation. Garment support members 30 are then mounted in the brackets 28 to extend between the opposing subframes 62. The garment support members 30 retain the subframes 62 in their opposed relation. Garments are then mounted on the garment support members 30 in a manner previously described. Once the garment support members 30 are filled with garments, the worker assembling the rack progresses rearwardly within the trailer to the next subframes 62 which are then pivoted into an opposing position, and garment support members positioned as discussed above. These garment support racks 30 are then loaded with garments. This operation progresses rearwardly within the trailer until the trailer is filled with garments and all subframes 62 are in opposed alignment and retained in that configuration by garment support members 30 mounted in the brackets 28. The garment support rack 60 is then in a garment support condition.

To move the garment support rack 60 into a stowed condition, the garments are unloaded from the open end of the cargo container 12, the garment support members 30 are removed from the opposing subframes 62, and the opposing subframes 62 are pivoted inwardly into generally parallel alignment with the side walls 14 of the cargo container 12. The worker stowing the garment support rack 60 then progresses inwardly to the next subframe assembly and removes the garments from the garment support members associated therewith. In a manner previously described, the subframes 62 are then pivoted into their stowed position generally parallel with the side walls 14 of the container 12. This operation progresses until all garments are removed from the trailer and all subframes 62 are in the stowed position.

By the above, the present invention provides a collapsible structure for supporting newly manufactured garments thereon for shipment, allowing the garments to arrive in a satisfactory condition, not requiring cleaning or pressing prior to distribution. In addition, the garment support rack may be configured to provide maximum storage space according to the size of the garments. Further, the garment support rack of the present invention may be collapsed and stowed in a compact condition thereby allowing the cargo container or trailer to be used for transporting additional cargo as well as the collapsed garment rack.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A collapsible garment support rack for transportation of a plurality of garments disposed on hooked garment hangers in a longitudinally extending cargo container of the general type having a cargo support surface and an associated cover, the cover being generally box-like and including a plurality of generally planar vertically oriented opposing side wall members, generally planar vertically oriented end wall members and a generally planar ceiling member disposed on the wall members, defining an interior compartment for cargo stowage, said garment rack comprising:

means for forming a garment supporting frame structure configured for occupation of the interior compartment of the cargo container including a frame structure being formed from a plurality of subframes, each subframe being framed from at least two vertical support members, and at least one horizontal support member extending therebetween for disposition across the transverse dimension of the cargo container, and a plurality of spacer members removably mounted to said subframes to extend longitudinally within the cargo container intermediate each subframe to position and stabilize said subframes along the longitudinal dimension of the cargo container and further including means for supporting garments thereon; and means for facilitating movement of said frame forming means between a garment support condition wherein said frame forming means is configured in an assembled disposition for occupation of the interior compartment of the cargo container for supporting garments within the cargo container for transportation of the garments, and a stowage condition wherein said frame forming means is in a disassembled disposition for transportation of the frame forming means.

2. A collapsible garment support rack according to claim 1 wherein said frame forming means forms a skeletal frame structure generally conforming in dimension with the interior compartment of the cargo container.

3. A collapsible garment support rack according to claim 1 wherein said vertically oriented support members are for disposition in a spaced relationship adjacent and along each opposing container side wall member thereby providing a plurality of adjacent vertical support members and a plurality of opposing support members, said garment support means extending between said opposing support members for supporting garments for transportation thereof and said spacer members extending between said adjacent support members for maintaining a predetermined spacing therebetween.

4. A collapsible garment support rack according to claim 3 wherein said vertical support members, said garment support means and said spacer means comprise means for forming a skeletal frame structure generally conforming in dimension with the interior of the cargo container.

5. A collapsible garment support rack according to claim 4 wherein said garment support means includes a plurality of elongate rods configured to extend between said opposing vertical support members and clamping means attached to said rod for releasably retaining garments being transported thereon.

6. A collapsible garment support rack according to claim 5 wherein said clamping means includes an elongate bar resiliently biased into a spaced relationship with said rod for insertion of hanger portions therebetween, said bar being movable between an opened condition for insertion and removal of hangers wherein said bar is biased away from said rod and a clamped condition for retention of hangers wherein said bar is biased toward said rod and into contact with said hangers.

7. A collapsible garment support rack according to claim 4 wherein said spacer means includes a plurality of elongate horizontally oriented support members configured to extend between said adjacent vertical support members.

8. A collapsible garment support rack according to claim 7 wherein said spacer means includes means for varying the length thereof thereby allowing said adjacent vertical support members to be spaced at predetermined intervals, for accumulation of garments of various widths.

9. A collapsible garment support rack according to claim 4 wherein said frame forming means includes a plurality of upstanding central support members disposed intermediate said opposing vertical support members with said garment support means extending between said vertical support members and said central support members.

10. A collapsible garment support rack according to claim 9 wherein said central support members and said opposing vertical support members are joined by at least one horizontally disposed cross member to form a primary frame structure, a plurality of primary frame structures being stackable when said garment rack is in its stowed condition.

11. A collapsible garment support rack according to claim 10 wherein said vertical support members include a plurality of pins projecting outwardly from one surface thereof at predetermined locations and a plurality of corresponding openings formed in an opposite surface thereof for mating of adjacent stacked primary frame structures when said garment rack is in its stowed condition.

12. A collapsible garment support rack according to claim 3 wherein said means for facilitating frame movement includes a plurality of bracket members mounted to said vertical support members at predetermined vertical spacings and configured for removably retaining said spacer means and said garment support means.

13. A collapsible garment support rack according to claim 12 wherein said means for facilitating frame movement includes a plurality of bracket members mounted to said vertical support members and configured for removably retaining said garment support means.

14. A collapsible garment support rack according to claim 12 wherein said spacer means include means for varying the length thereof thereby allowing said adjacent vertical support members to be disposed at various different predetermined spacings according to garment width.

15. A collapsible garment support rack according to claim 3 wherein said frame forming means includes a starter frame member including at least two vertical support members, a plurality of cross brace members extending therebetween and means for removably mounting said spacer means thereon to join said starter frame member with said vertical support members, said starter frame member being for erection adjacent the end wall of the cargo container when said frame forming means is in a garment support condition and for disposition on the remainder of the frame forming means when said frame forming means is in a stowed condition for supporting cargo thereon.

16. A collapsible garment support rack for transportation of a plurality of garments disposed on hooked garment hangers in a cargo container of the general type having a cargo support surface and an associated cover, the cover being generally box-like and including a plurality of generally planar vertically oriented side wall members, a generally planar vertically oriented end wall member, and a generally planar ceiling member disposed on the wall members defining an interior compartment for cargo stowage, said garment rack comprising:

means for forming a skeletal garment support frame structure generally conforming in dimension with the interior compartment of the cargo container including a plurality of generally vertically oriented support members for disposition in a spaced relationship adjacent the side wall members providing a plurality of adjacent vertical support members and a plurality of opposing vertical support members, garment support means including a plurality of elongate rods for supporting garments for transportation thereof, spacer means including a plurality of elongate horizontally oriented support members configured to extend between said adjacent vertical support members and a plurality of upstanding central support members disposed intermediate said opposing vertical support members with said garment support means extending between said opposing vertical support members and said central support members; and means for facilitating movement of said frame forming means between a garment support condition wherein said frame forming means is configured in an assembled upstanding disposition for occupation of the interior of the cargo container and a stowage condition wherein said frame forming means is in a disassembled, stacked condition for transportation thereof including a plurality of bracket members mounted to said vertical support members and configured for removably retaining said spacer means and said garment support means.

17. A collapsible garment support rack according to claim 16 wherein said frame forming means includes a starter frame member including at least two vertical support members, a plurality of cross brace members extending therebetween and means for removably mounting said spacer means thereon to join said starter frame member with said vertical support members, said starter frame member being for erection adjacent the end wall of the cargo box when said frame forming means is in a garment support condition and for disposition on the stacked remainder of the frame forming means when said frame forming means is in a stowed condition for supporting cargo thereon.

18. A collapsible garment support rack according to claim 1 wherein said frame forming means includes a plurality of subframe members pivotably mounted to the cargo floor along and adjacent each opposing side wall member providing a plurality of adjacent subframe members and a plurality of opposing subframe members, each said subframe member including means for supporting garments thereon and being pivotable between a garment support condition wherein said subframe members are oriented in a generally perpendicular relation with said side wall members and a stowed condition wherein said subframe members are oriented in a generally parallel relation with the side wall members.

19. A collapsible garment support rack according to claim 18 wherein each said subframe includes two vertically oriented support members in a spaced, generally parallel relation with at least one garment support member extending therebetween.

20. A collapsible garment support rack according to claim 19 wherein said garment support means includes a plurality of elongate rods configured to extend between said opposing vertical support members and clamping means attached to said rod for releasably retaining garments being transported thereon.

21. A collapsible garment support rack according to claim 20 wherein said clamping means includes an elongate bar resiliently biased into a spaced relationship with said rod for insertion of hanger portions therebetween, said bar being movable between an opened condition for insertion and removal of hangers wherein said bar is biased away from said rod and a clamped condition for retention of hangers wherein said bar is biased toward said rod and into contact with the hangers.

22. A collapsible garment support rack according to claim 18 wherein said means for facilitating frame movement includes a plurality of bracket members mounted to said subframe vertical support members and configured for removably retaining said garment support means.

23. A collapsible garment support rack according to claim 22 wherein said garment support means are movable between said bracket members for removably mounting said garment support members at predetermined vertical spacings thereby allowing said garment support rack to accommodate garments of various different lengths.

24. A collapsible garment support rack according to claim 20 wherein said subframes are in a generally aligned, opposed configuration when in said garment support condition and each vertical support member includes a plurality of bracket members mounted thereon in a spaced vertical relation, said garment support means being selectively mountable in said bracket members to extend between said opposed subframes to retain said subframes in said garment supporting condition, and said garment support means being movable between said bracket members thereby allowing said garment support means to be mounted at predetermined vertical spacings dependent on garment height.

25. A collapsible garment support rack according to claim 18 and further comprising means for selectively and removably mounting said adjacent subframe members at predetermined spacings for accommodation of garments of various widths.

26. A collapsible garment support rack according to claim 25 wherein said subframe mounting means includes a plurality of generally linearly aligned openings formed in the cargo floor and the ceiling member along and adjacent the side walls, and a plurality of mounting members projecting from each subframe and configured for mating with said openings.

27. A collapsible garment support rack for transportation of a plurality of garments disposed on hooked garment hangers in a cargo container of the general type having a cargo support surface and an associated cover, the cover being generally box-like and including a plurality of generally planar vertically oriented opposing side wall members, generally planar vertically oriented end wall members and a generally planar ceiling member disposed on the wall members, defining an interior for cargo stowage, said garment rack comprising:

means for forming a garment supporting frame structure configured for occupation of the interior of the cargo container including a plurality of subframe members pivotably mounted to the cargo floor at predetermined spacings adjacent each opposing side wall member, each subframe member including at least two upstanding vertical support members, at least one horizontal support member, and at least one garment supporting member extending therebetween, each subframe being pivotable between a garment supporting condition wherein said subframe members oriented in a generally perpendicular relation with the side wall members and a stowed condition wherein said subframe members are oriented in a generally perpendicular relation with the side wall members; and a plurality of garment support members configured to extend between two said subframes and being selectively removably mountable thereto at predetermined vertical spacings to retain said subframes in said garment supporting condition and to support garments thereon.

* * * * *